United States Patent [19]

Lambert, III

[11] Patent Number: 4,913,596

[45] Date of Patent: Apr. 3, 1990

[54] ATHLETIC FIELD CONSTRUCTION

[75] Inventor: Louis N. Lambert, III, Northport, Ala.

[73] Assignee: Erosion Control Systems, Inc., Tuscaloosa, Ala.

[21] Appl. No.: 347,032

[22] Filed: May 4, 1989

[51] Int. Cl.[4] ..... E02B 13/00

[52] U.S. Cl. ..... 405/43; 405/36; 405/45

[58] Field of Search ..... 415/37, 36, 43, 45, 415/38, 39; 47/56–59, 1 R

[56] References Cited

U.S. PATENT DOCUMENTS

| | | | |
|---|---|---|---|
| 3,461,675 | 8/1969 | Izatt . | |
| 3,908,385 | 9/1975 | Daniel et al. . | |
| 4,023,506 | 5/1977 | Robey | 405/43 X |
| 4,268,993 | 5/1981 | Cunningham . | |
| 4,462,184 | 7/1984 | Cunningham | 405/37 X |
| 4,576,511 | 3/1986 | Vidal | 405/37 |

*Primary Examiner*—Dennis L. Taylor

*Attorney, Agent, or Firm*—Cushman, Darby & Cushman

[57] ABSTRACT

An athletic field in which a subgrade is initially formed with a series of ditches having a series of drain tiles therein exteriorly covered with pea gravel. A layer of pea gravel is mounted over the subgrade including the ditches having drain tile covered with pea gravel. A layer of crushed stone is mounted over the layer of pea gravel. A layer of sand having an infiltration rate of at least 9" per hour is mounted over the layer of crushed stone. A layer of soil mixture having an infiltration rate of between 5" to 9" per hour is mounted over the layer of sand. The layer of soil mixture has a layer of soil reinforcement matting spaced from the upper surface thereof within a two-inch upper strata of the soil mixture layer. The upper surface of the layer of soil mixture has thereon either grass sod, grass sprigs, or grass seed for establishing a grass growth thereon.

20 Claims, 2 Drawing Sheets

ATHLETIC FIELD CONSTRUCTION

Figure 1:
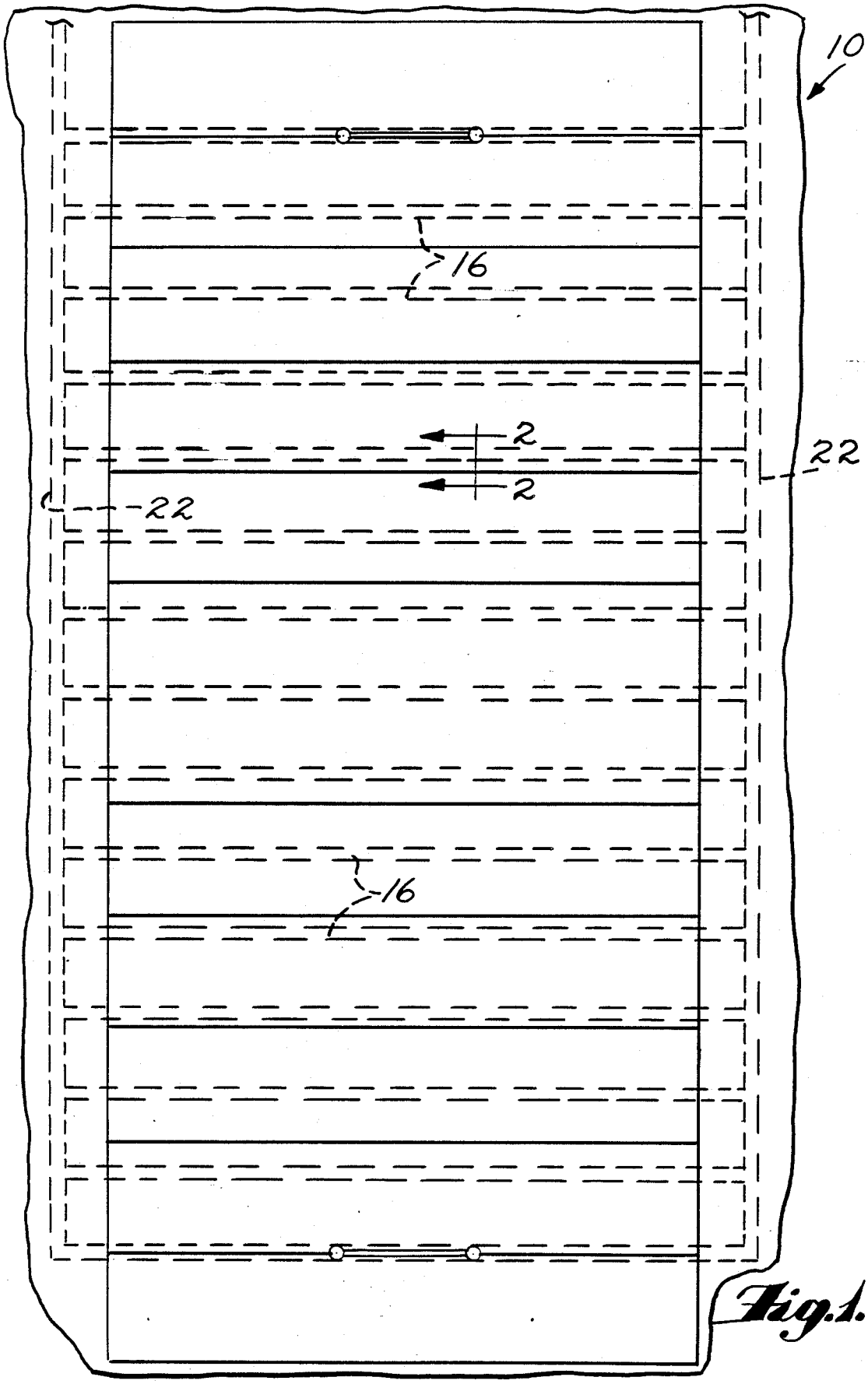

This invention relates to athletic fields and the like and, more particularly, to improvements in the constructions of natural turf athletic fields.

It is generally accepted that natural turf athletic fields are preferred to artificial fields and yet the utilization of artificial fields seems to be increasing. This apparent anomaly would seem to indicate that, despite the long experience and history in establishing and maintaining natural turf fields, see for example U.S. Pat. Nos. 3,461,675, 3.908,385, and 4,268,993, artificial fields are either actually more cost effective or perceived to be more cost effective. In any event, there is clearly a need to make natural turf athletic fields more cost effective. Such cost effectiveness entails both minimizing the initial and maintenance costs, as well as enhancing the effectiveness of the performance particularly as compared with the performance of artificial turf fields.

It is an object of the present invention to fulfill the above-described need. The present invention is based upon the underlying concept that a particular combination of components are required to accomplish the objective, many or all of which may be individually known. In accordance with the principles of the present invention , the objective is achieved by providing an athletic field which comprises a subgrade formed with a series of ditches having drain tile therein exteriorly covered with pea gravel, a layer of pea gravel over the subgrade including the ditches having drain tile covered with pea gravel, a layer of crushed stone over the layer of pea gravel, a layer of sand having an infiltration rate of at least 9" per hour over the layer of crushed stone, and a layer of soil mixture having an infiltration rate of between 5" to 9" per hour over the layer of sand. The layer of soil mixture has a layer of soil reinforcement matting spaced from the upper surface thereof within a two-inch upper strata of the soil mixture layer. Finally, on the upper surface of the layer of soil mixture a grass growth is established either by providing sod, by installing grass sprigs or by grass seeding.

Another object of the present invention is the provision of an athletic field of the type described which is simple in construction, effective in operation, and economical to produce and maintain.

These and other objects of the present invention will become more apparent during the course of the following detailed description and appended claims.

The invention may best be understood with reference to the accompanying drawings wherein an illustrative embodiment is shown.

Figure 2:
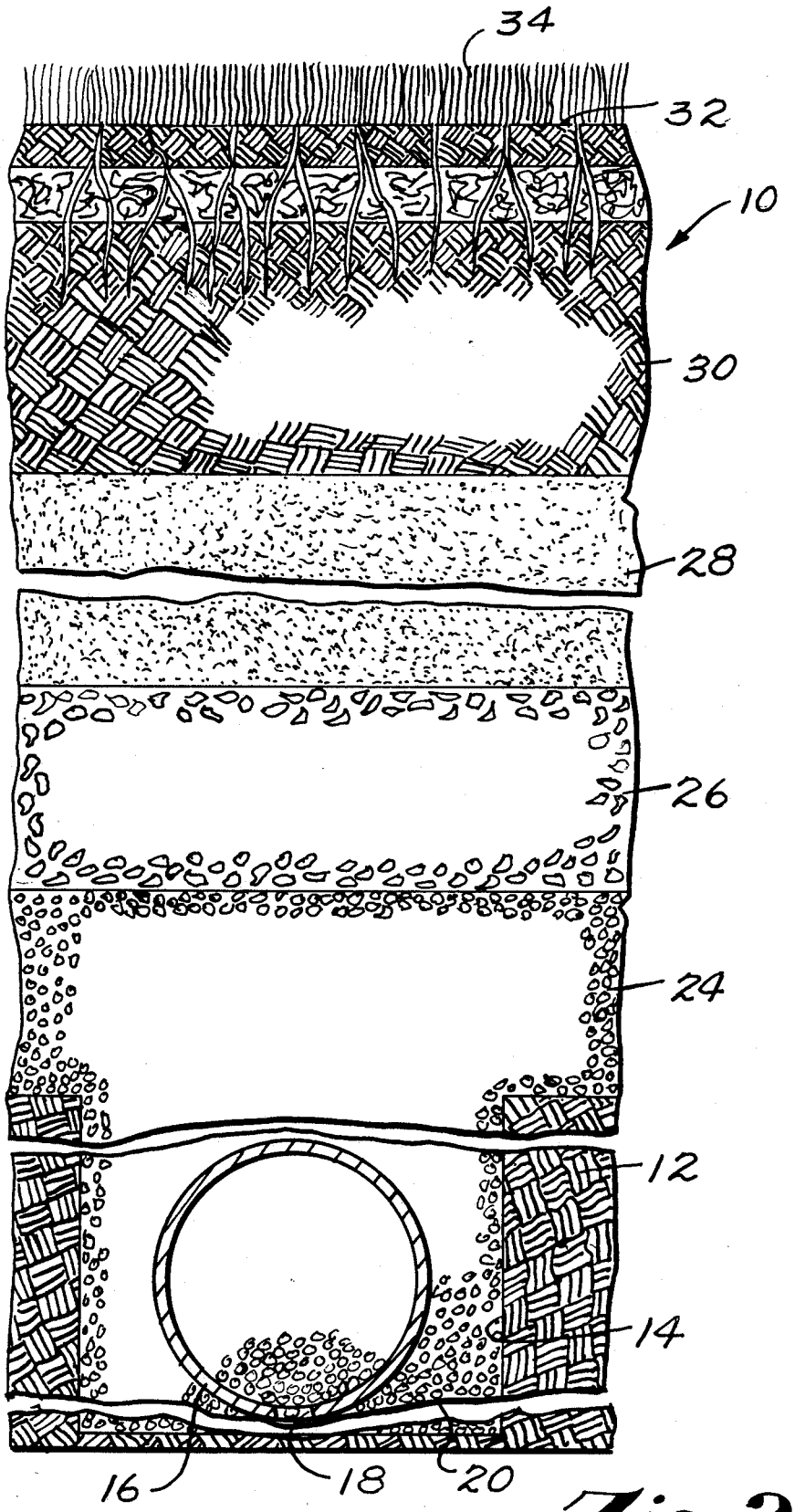

IN THE DRAWINGS:

FIG. 1 is a top plan view of an athletic field constructed in accordance with the principles of the present invention; and FIG. 2 is an enlarged fragmentary sectional view taken along the lines 2—2 of FIG. 1.

Referring now more particularly to the drawings, there is shown in FIG. 1 a top plan view of an athletic field, generally indicated at 10, which is constructed in accordance with the principles of the present invention. The exemplary field 10 shown in the drawings is a football field, although it will be understood that other types of athletic fields such as soccer, polo, and the like are also contemplated. The principles of the present invention are also applicable to other types of athletic fields which are not necessarily rectangular in plan, such as baseball fields, golf courses, and the like. Moreover, the particular characteristics which the present invention provide are particularly suited to fields of the type which are subject to the kind of heavy traffic and treatment which football and similar games present.

As shown in FIG. 1, the athletic field 10, since it is a football field, is indicated by markings of the conventional type which designate the playing area. It is well known, however, that an extensive fringe area outside the playing area is normally provided. A common configuration is to encircle the field with an oval track or the like (not shown in FIG. 1).

FIG. 2 illustrates the construction of the field. As shown therein, the field includes a subgrade, which is designated by the numeral 12. The subgrade is graded and sloped with a crown of approximately 6". In the football field 10 shown, the crown extends from goal post to goal post throughout the midportion of the playing area. Formed in the subgrade 12 is a series of parallel ditches 14. The ditches 14 extend across the field area and each is approximately 8" across and 8" deep. The ditches 14 are parallel with one another and spaced apart approximately 20' from one another. Mounted within the series of ditches 14 is a series of drain tiles 16. The drain tiles 16, as shown, may be of cylindrical configuration. They are preferably slitted along their lower portions, as indicated at 18, and disposed within the ditches 14 so as to be surrounded by pea gravel 20 which fills the ditches 14. As shown in FIG. 1, each length of drain tile 16 is positioned to drain into a header pipe 22 extending along the field outside the playing area.

Disposed above the subgrade 12 and the pea gravel filled ditches 14 therein is a layer of pea gravel 24 which follows the grade and slope of the subgrade and has a thickness of approximately 3". Mounted above the layer of pea gravel 24 is a layer of crushed rock 26 which has a size which is preferably approximately like #89 crushed rock. Here again, the crushed rock layer 26 follows the graded slope of the subgrade 12 and has a thickness of approximately 3".

Disposed above the layer of crushed rock 26 is a layer of sand 28 which likewise follows the grade and slope of the subgrade. The sand layer 28 preferably has a thickness of approximately 6". The grade of sand utilized in the sand layer 28 is preferably a grade which has a water infiltration rate of at least 9" per hour.

Mounted above the layer of sand 28 is a layer of soil mixture 30. This soil mixture may include sand, soil and other additives which tend to create an optimum growing media. The consistency of the soil mixture is such that it has an infiltration rate of between 5" to 9" per hour. The particular characteristics of the soil mixture can be custom fitted to each individual field depending upon its location so as to fit the particular environmental conditions presented. The layer of soil mixture 30 likewise follows the subgrade so that it presents the upper surface 32 which is graded and sloped with a 6" crown. Mounted in spaced relation to the upper surface 32 of the soil mixture layer 30 within a 2" strata is a sod reinforcing matting 34. A preferred mating 34 is the construction which is currently manufactured and sold under the registered trademark ENKAMAT. This matting is made by first forming a web of open randomly intermeshed thermoplastic monofilaments having their interstices fixedly interconnected by heat fusion or the like. Thereafter, the web is permanently transversely deformed in waffle-like fashion, as by passing the web between heated forming rolls which form spaced intermeshed depressions on both sides of the web. The web is thus permanently deformed into a thickened mating having a thickness substantially greater than the thickness of the web.

It will be noted that the upper surface 32 of the soil mixture layer 30 is defined by a layer of sod 34. Where conditions and time constraints allow, the sod may be replaced by grass sprigs or by grass seeding. With the present construction, there is provided a desirable soil mixture layer near the top of the field which has a soil reinforcement matting in the upper 2" strata thereof which serves to retain the grass growing above the upper surface of the layer of soil mixture 30. The layers beneath the soil mixture provide a desirable water retention and water shedding characteristic which tends to ameliorate the extreme conditions of too much water or too little water. The soil reinforcement matting takes care of the heavy traffic conditions on the natural turf upper surface of the field and prevents the turf from being disrupted and deteriorating into a situation where bare spots occur in the areas of heaviest traffic.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modification encompassed within the spirit and scope of the following claims.

What is claimed is:

1. A prepared athletic field or the like comprising a subgrade formed with a series of ditches having a series of drain tiles therein exteriorly covered with pea gravel, a layer of pea gravel in direct contact with the subgrade including the ditches having drain tile covered with pea gravel, a layer of crushed stone over the layer of pea gravel, a layer of sand having an infiltration rate of at least 9" per hour over the layer of crushed stone, a layer of soil mixture having an infiltration rate of between 5 to 9" per hour over the layer of sand, said layer of soil mixture having a layer of soil reinforcement matting spaced from the upper surface thereof within a two-inch upper strata of said soil mixture layer, and means on the upper surface of the layer of soil mixture for establishing a grass growth thereon, said matting serving to prevent the grass from being disrupted by rough athletic use of the like.

2. A prepared athletic field as defined in claim 1 wherein said subgrade is graded and sloped with a crown of approximately 6", each of said ditches being approximately 8" deep.

3. A prepared athletic field as defined in claim 2 wherein each of said series of drain tiles is generally cylindrical having a diameter of approximately 4", said series of drain tiles being slit along lower portions thereof and being disposed in parallel relation across the athletic field spaced apart approximately twenty feet from one another, said series of drain tiles leading into solid header pipes embedded outside a playing area of the athletic field.

4. A prepared athletic field as defined in claim 3 wherein said layer of pea gravel is approximately 3" deep, the pea gravel thereof having a diameter of between $\frac{1}{4}$" and $\frac{3}{8}$".

5. A prepared athletic field as defined in claim 4 wherein said layer of crushed stone is approximately 3" deep, the crushed stone being of a size approximating number 89 crushed stone.

6. A prepared athletic field as defined in claim 5 wherein said layer of sand is approximately 6" deep.

7. A prepared athletic field as defined in claim 6 wherein said layer of soil mixture is approximately 6" deep.

8. A prepared athletic field as defined in claim 7 wherein said matting comprises a web of open randomly intermeshed thermoplastic monofilaments having fixedly secured interstices, said web being permanently transversely deformed in waffle-like fashion into matting having a thickness substantially greater than the thickness of said web.

9. A prepared athletic field as defined in claim 8 wherein said grass growth establishing means comprises sod.

10. A prepared athletic field as defined in claim 8 wherein said grass growth establishing means comprises grass sprigs.

11. A prepared athletic field as defined in claim 8 wherein said grass growth establishing means comprises grass seeds.

12. A prepared athletic field as defined in claim 1 wherein each of said series of drain tiles is generally cylindrical having a diameter of approximately 4", said series of drain tiles being slit along lower portions thereof and being disposed in parallel relation across the athletic field spaced apart approximately twenty feet from one another, said series of drain tiles leading into solid header pipes embedded outside a playing area of the athletic field.

13. A prepared athletic field as defined in claim 1 wherein said layer or pea gravel is approximately 3" deep, the pea gravel thereof having a diameter of between $\frac{1}{4}$" and $\frac{3}{8}$".

14. A prepared athletic field as defined in claim 1 wherein said layer of crushed stone is approximately 3" deep, the crushed stone being of a size approximating number 89 crushed stone.

15. A prepared athletic field as defined in claim 1 wherein said layer of sand is approximately 6" deep.

16. A prepared athletic field as defined in claim 1 wherein said layer of soil mixture is approximately 6" deep.

17. A prepared athletic field as defined in claim 1 wherein said matting comprises a web of open randomly intermeshed thermoplastic monofilaments having fixedly secured interstices, said web being permanently transversely deformed in waffle-like fashion into matting having a thickness substantially greater then the thickness of said web.

18. A prepared athletic field as defined in claim 1 wherein said grass growth establishing means comprises sod.

19. A prepared athletic field as defined in claim 1 wherein said grass growth establishing means comprises grass sprigs.

20. A prepared athletic field as defined in claim 1 wherein said grass growth establishing means comprises grass seeds.

* * * * *